United States Patent [19]

Yuda et al.

[11] 4,393,556

[45] Jul. 19, 1983

[54] PLASTIC BUCKLE

[75] Inventors: Takuo Yuda, Yokohama; Akira Mizusawa, Fujisawa, both of Japan

[73] Assignee: Nifco, Inc., Tokyo, Japan

[21] Appl. No.: 253,325

[22] Filed: Apr. 13, 1981

[30] Foreign Application Priority Data

Apr. 18, 1980 [JP] Japan ..... 55-51812[U]

[51] Int. Cl.[3] ..... B65D 63/00

[52] U.S. Cl. ..... 24/230 R

[58] Field of Search ..... 24/230 R, 205 R, 205.18, 24/208 R, 182 R

[56] References Cited

U.S. PATENT DOCUMENTS

| | | | |
|---|---|---|---|
| 2,836,868 | 6/1958 | Carter | 24/230 R |
| 2,901,794 | 9/1959 | Prete | 24/230 R |
| 3,716,895 | 2/1973 | Fohr | 24/230 R |

FOREIGN PATENT DOCUMENTS

| | | | |
|---|---|---|---|
| 2451175 | 10/1980 | France | 24/230 AS |

*Primary Examiner*—Robert A. Hafer
*Assistant Examiner*—Wenceslao J. Contreras
*Attorney, Agent, or Firm*—Jerold M. Forsberg; Thomas W. Buckman; Jack R. Halvorsen

[57] ABSTRACT

A plastic buckle comprises an obverse half buckle member provided with an engaging piece and snap engaging means and a reverse half buckle member provided at the positions corresponding to those of the first half buckle member with surface portions adapted to be caught by the engaging piece and snapping engaging means. These two half buckle members are assembled into one complete buckle by fastening the surface portions to the engaging portion and rotating the two half buckle members toward each other with the point of contact thereof serving as the fulcrum of rotation until they come into fast union.

6 Claims, 13 Drawing Figures

1
2
3
4
5
6
7
8
9
10
11
12
13
14
15
16
17
18
19
20
22
23
24
25
26
27
28
29
6a
21
30

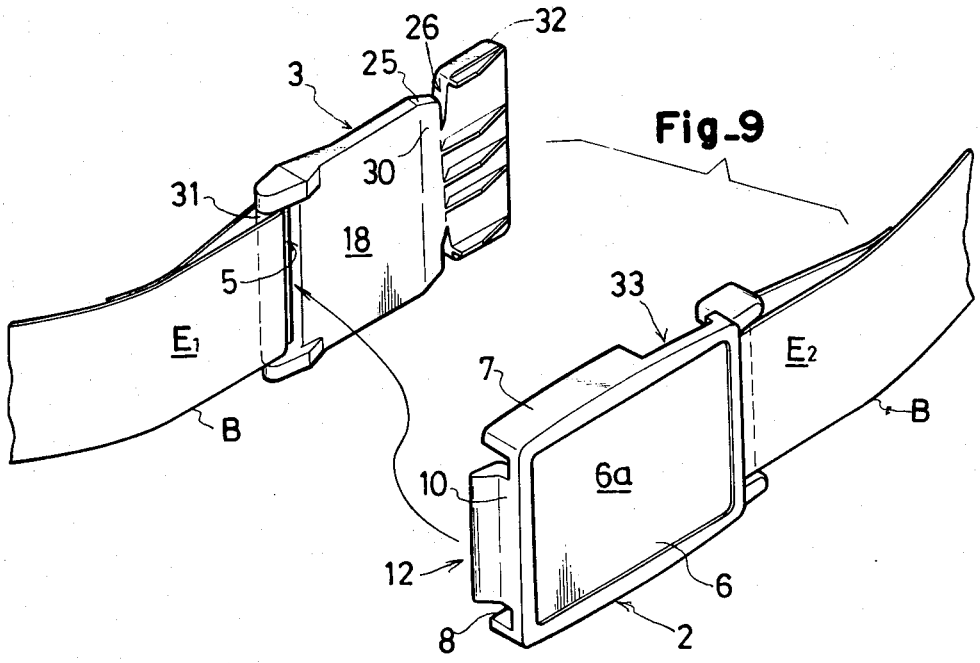
Fig-9
Fig-10
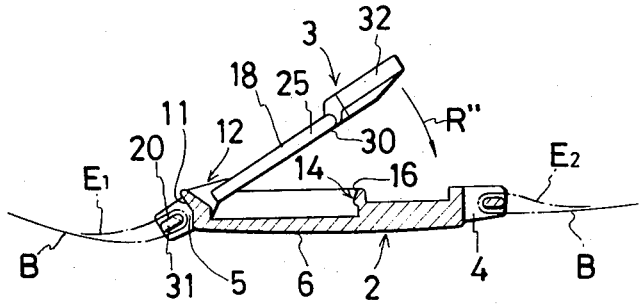
Fig-13
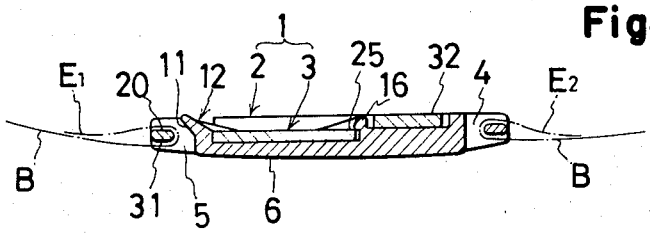

PLASTIC BUCKLE

BACKGROUND OF THE INVENTION

This invention relates to a plastic buckle for use on a belt.

From early times, most buckles for belts used on garments have been made of metals. They are expensive and take much time and labor to manufacture. Thus, attempts have been made to produce buckles from plastics and other materials which are easy to form. The conventional buckles made of these materials, however, have involved disadvantages in that they comprise numerous parts or they are complicated in shape and, for these reasons, in that they require troublesome molding work. (U.S. Pat. No. 4,150,464 and Japanese Utility Model Laid-open Publications No. 30001/1978 and No. 110025/1978).

SUMMARY OF THE INVENTION

One object of this invention is to provide a plastic buckle which is easy to form, enjoys a pleasing appearance and provides secure fastening.

To accomplish the object described above according to the present invention, there is provided a plastic buckle which comprises two half buckle members each provided in the lateral edge thereof with a slit for passing a belt end, one of the half buckle members being provided with an engaging piece and a snap engaging means and the other half buckle member being provided with a surface member adapted to be caught on the aforementioned engaging piece and a snap engaging means adapted for fast engagement with the aforementioned first snap engaging means, whereby the two half buckle members are brought into fast unit by preparatorily causing the engaging piece to catch hold of the surface member and subsequently rotating both the half buckle members toward each other with the joint by the catch serving as the fulcrum.

The other objects and characteristics of the present invention will become apparent from the further disclosure of the invention to be made hereinafter with reference to the accompanying drawing.

BRIEF EXPLANATIONS OF THE DRAWING

FIG. 9 is an exploded perspective front view of the buckle of the second embodiment.

FIG. 10 is a cross-sectioned view of the buckle of FIG. 9 in the process of assemblage.

FIG. 13 is a cross-sectioned view of the buckle as held in the state of FIG. 12.

DESCRIPTION OF THE PREFERRED EMBODIMENT

Figures 1, 2:
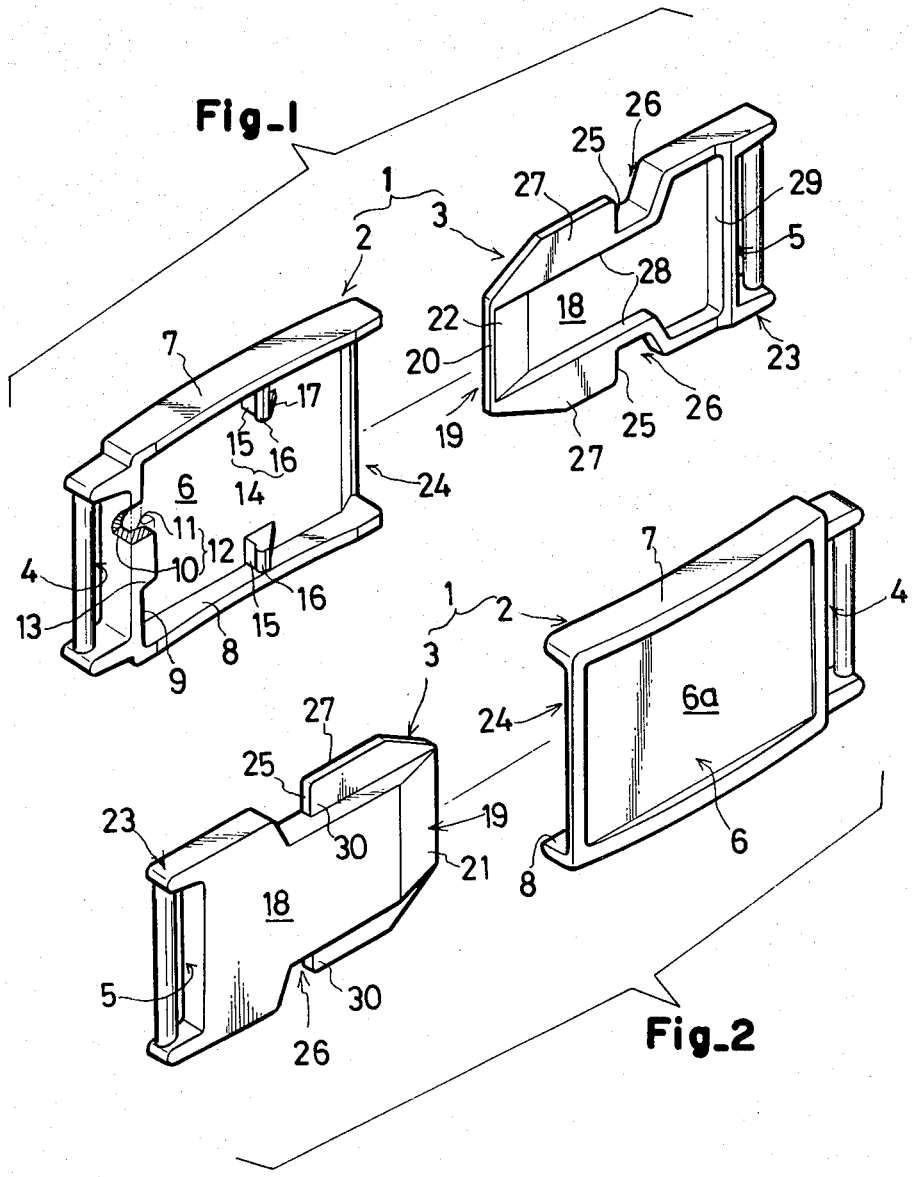
FIG. 1 is an exploded perspective rear view of the first embodiment of the buckle of this invention.
FIG. 2 is an exploded perspective front view of the buckle of FIG. 1.

Referring to FIGS. 1–6, the buckle 1 of the present invention is formed of a front half buckle member 2 and a rear half buckle member 3. These two half buckle members 2, 3 complete the buckle 1 when they are joined fast with the former in front of the latter by a manipulation to be fully described afterward. A pair of insertion slits 4, 5 are formed at the opposite ends of the complete buckle 1 for the purpose of holding the free end portions of a belt and are disposed so that they will fall one each on the two half buckle members. To be specific, one belt insertion slit 4 is formed along one lateral edge of one half buckle member 2 in the shape of a hole extending in the vertical direction and opening in the front-rear direction, and the other belt insertion slit 5 is formed in a similar shape along the opposite lateral edge of the other half buckle member 3.

The one half buckle member 2 is destined to occupy its position on the obverse side (front side) and the other half buckle member 3 on the reverse side (rear side) respectively. First, reference is made to the obverse half buckle member 2. This half member 2 is possessed of a front plate 6, and the front surface 6*a* of this front plate 6 serves as an ornamental face of the complete buckle of the belt. This ornamental face 6*a* can contain any design freely chosen by the manufacturer or user of the buckle. Since the design contained therein has no direct bearing upon the construction of the present invention, the ornamental face is depicted simply as a flat surface in the drawing.

Along the upper and lower ends of the front plate 6, there are provided upper and lower frame members 7, 8 which rise toward the rear side. Along the edge of this half member 2 opposed to the insertion slit 4, there is provided a lateral plate 9. The choice of the framework of the front half member itself is chiefly a matter of appearance, for the framework functions to conceal the other half member 3 which is destined to occupy its position behind the front half member as described more fully afterward.

In the case of the front half member 2, near the lateral edge thereof opposed to the belt insertion slit 4, there is, further provided an engaging piece 12 which rises toward the rear side in a portion 10 and then bends in a direction parallel to the front plate 6 to define a face portion 11 looking toward the front side. This engaging piece 12 is destined to serve as the fulcrum for the rotation of the other half member 3 during its attachment as will be more fully described afterward. In FIG. 1, since the face portion 11 which looks toward the front side is looked at from behind, only the rear face 13 opposite the face portion 11 is seen in the drawing.

The front half buckle member 2 is further provided with a snap engaging means 14 which admits the rear half buckle member 3 into tight engagement and retains it fast in the state of engagement. In the present embodiment, this snap engaging means 14 is composed of ribs 15 rising from the rear surface of the front plate 6 and extending somewhat downwardly and upwardly from the upper and lower frame members at points falling halfway between the opposite lateral edges of the front plate and roundish protuberances 16 formed at the rearwardly protruding ends of the ribs 15. Behind these protuberances 16, there are provided triangular ribs 17 adapted to confer necessary strength upon the protuberances.

Figure 3:
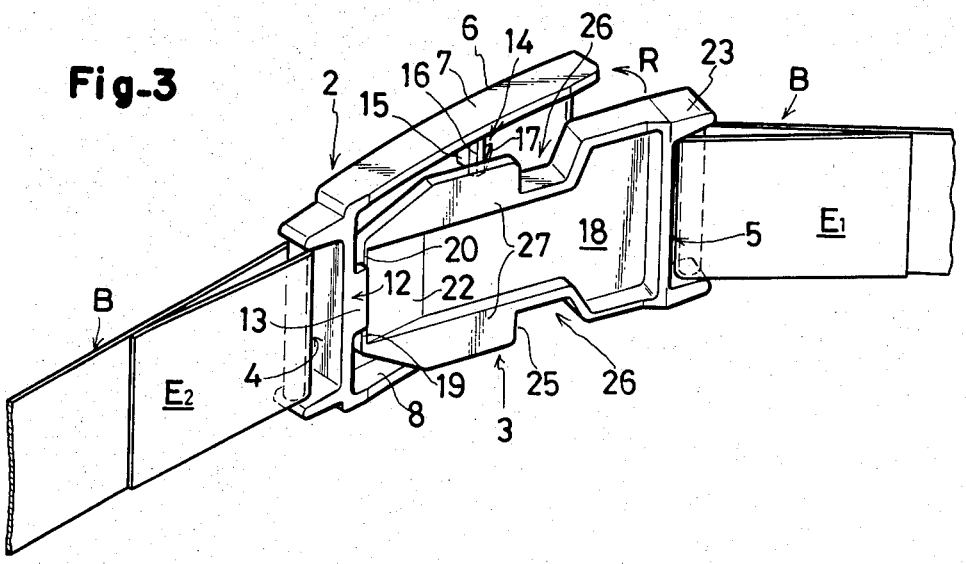
FIG. 3 is a perspective view illustrating the buckle of FIG. 1 in the process of assemblage.
Figure 4:
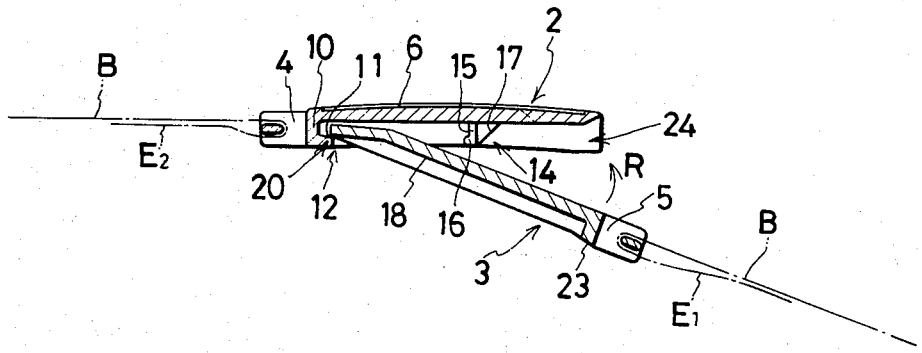
FIG. 4 is a cross-sectioned view of the buckle as held in the state shown in FIG. 3.

The other half buckle member 3 is substantially composed of a plate-shaped base plate portion 18. It appears to have a somewhat abnormal shape, because the wall of this base plate portion 18 is totally removed or partially shaved off at numerous points for the economization of material. To describe the essential components, along the lateral edge 19 opposite the belt-insertion slit 5 formed on one lateral edge of the base plate portion 18, there is provided a rearwardly directed surface portion 20 adapted for engagement with the forwardly directed face portion 11 of the engaging piece 12 of the half buckle member 2. The aforementioned lateral edge 19 is possessed of a surface 21 inclined in the direction of gradually thinning the wall toward the leading edge thereof, so that the lateral edge 19 incorporating the surface portion 20 may be inserted between the engaging piece 12 and the front plate 6 (FIGS. 3–4). The rear side of the base plate portion 18 is shaved off parallelly to the rear surface 22 opposite the inclined surface 21. Consequently, this rear surface 22 is also inclined.

The base plate portion 18 is desired to have an area such that it will not extend beyond the boundary of the front plate 6. The rectangularly constructed portion 23 which gives shape to the belt-insertion slit 5 is given a size such that, on completion of the assemblage to be effected as described more fully afterward, it will protrude sideways from the complete buckle 1 through the lateral opening 24 of the other half buckle member.

On the upper and lower sides of the base plate portion 18, there are formed surface portions 25 adapted to catch hold of snap engaging protuberances 16 of the other half member 2. To permit formation of these surface portions 25 and also permit escape of the protuberances 16 and the triangular ribs 17, there are formed downward and upward notches 26. The upper and lower portions stretching from the free lateral edge 19 to the surface portion 25 are thinly formed plate-shaped portions 27 to permit saving of the material. This thinness of the wall additionally serves to provide the slight deformability which the surface portions 25 are required to exhibit during the snapping engagement to be described more fully afterward.

Owing to the total and partial removal of the wall described above, the half member 3 of the present embodiment assumes a framework construction provided on the upper and lower sides of the base plate portion 18 with upper and lower frame members 28, along the insertion slit 5 with a lateral frame member 29 and along the opposite lateral edge with the aforementioned inclined rear surface 22. This framework construction gives a satisfactory effect from the standpoint of strength.

Now, the manner in which the two half buckle members 2, 3 constructed as described above are assembled into one complete buckle will be described.

First, as illustrated in FIGS. 3–4, the free lateral edge 19 of the half buckle member 3 is inserted into the gap between the engaging piece 12 and the front plate 6 of the half buckle member 2 so that the surface portion 20 of the free lateral edge 19 will collide with the front face portion 11 of the engaging piece 12.

Figure 5:
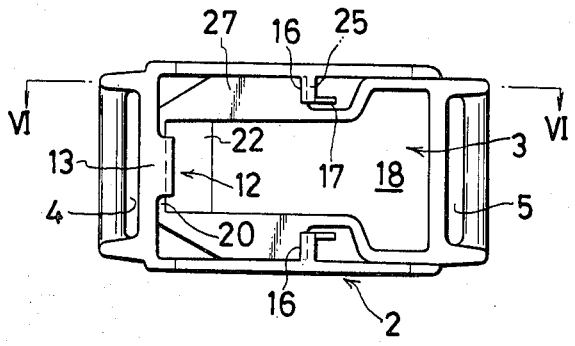
FIG. 5 is a rear view of the buckle of FIG. 1 as held after completion of the assemblage.
Figure 6:
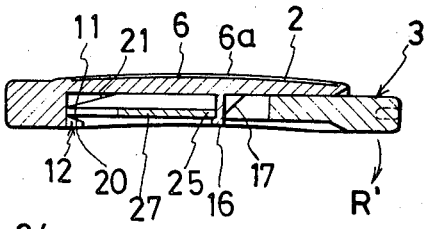
FIG. 6 is a sectional view taken along the line VI—VI shown in FIG. 5.
Figure 7:
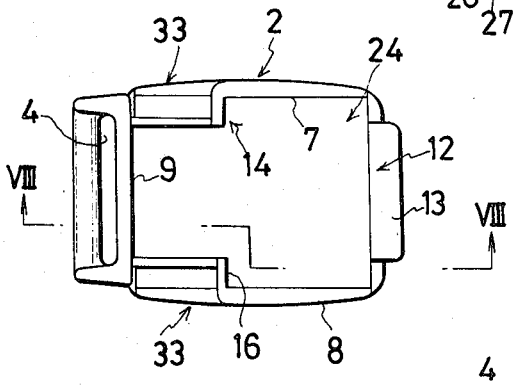
FIG. 7 is a rear view of the front half buckle member in the second embodiment of the buckle of this invention.
Figure 8:
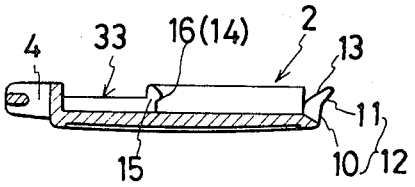
FIG. 8 is a sectional view taken along the line VIII—VIII shown in FIG. 7.

In the resultant state, the two half buckle members 2, 3 are rotated toward each other as indicated by the arrow "R", with the point of contact between the engaging piece 12 and the face portion 20 serving as the fulcrum of the rotation,namely in the direction of bringing the opposed lateral edges into direct contact. Consequently, the snap engaging protuberances 16 of the half buckle member 2 collide with the surfaces 30 opposite the surface portions 25 (shown clearly in FIG. 2). As the aforementioned rotation of the two half buckle members is further continued, the protuberances 16 and/or the surface portions 25 continue to advance while being resiliently deformed or bent. As th protuberances 16 subsequently reach the surface portions 25, they are relieved of the deformation and, as a result, the protuberances 16 snap into fast engagement with the surface portions 25. Thus, the two half buckle members 2, 3 come into fast union to complete the buckle 1, as illustrated in FIGS. 5 and 6.

In other words, if the opposite ends $E_1$, $E_2$ of a given belt B are fastened in advance to the two half buckle members by the medium of the respective insertion slits 4, 5 (FIG. 3), the work of assemblage described above turns out to be a work which is performed by the user of the belt in wearing that belt on his person.

Removal of the belt worn on the body, as is evident from the foregoing description, can be accomplished by reversing the aforementioned work of assemblage, namely, by rotating the half buckle member 3 in the opposite direction R′ (FIG. 6) to effect forced breakage of the engagement between the protuberances 16 and the surface portions 25. It is for the purpose of this separation that the protuberances 16 have a roundish contour. These protuberances 16 may be in any of the numerous known snap engaging constructions capable of such forced separation. Since the works for the assemblage and separation of the two half buckle members make use of a sort of leverage effected around one point as the fulcrum, the operation of the buckle is quite simple.

FIGS. 7–13 illustrate the second embodiment of the buckle of this invention. This second embodiment uses the same basic components as the first embodiment. It differs from the first embodiment in respect that the fulcrum of rotation falls on the lateral edge opposite that in the first embodiment and that, consequently, the direction of the rotation involved during the union of the two half buckle members is reversed.

To be more specific, the engaging piece 12 on the front half buckle member 2 containing the ornamental front plate 6 is formed on the side opposite the lateral edge containing the belt-insertion slit 4. Nevertheless, this engaging piece 12 has the same construction as that of the first embodiment in respect that it rises in the rearward direction through a portion 10 and then bends sideways at the leading end of the rising portion 10 to define the face portion 11 directed to the front side.

The protuberances 16 of the engaging means 14 of the half buckle member 2 are extended downwardly and upwardly from points falling partway between the upper and lower frame members 7, 8. The direction in which these protuberances are extended is opposite that of the first embodiment.

On the rear half buckle member 3, accordingly, the surface portion 20 serving to catch hold of the engaging piece 12 is formed at the corresponding position. In the present embodiment, the surface portion 20 is not independently formed. Instead, the rear surface of the supporting portion 31 which constitutes the outer lateral side out of the sides defining the belt-insertion slit 5 on the opposite lateral edge is utilized as the surface portion 20 (FIGS. 10–13). In this arrangement, the engaging piece 12 is brought into indirect contact with the surface portion 20 through the medium of the end $E_1$ of the belt B. In effect, the engaging piece 12 is fit into the belt-insertion slit 5.

The surface portions 25 adapted to be separably joined to the protuberances 16 of the snap engaging means 14, similarly to those in the first embodiment, are formed in a laterally directed form by inserting notches 26 in the upper and lower sides of the base plate portion 18.

Figure 11:
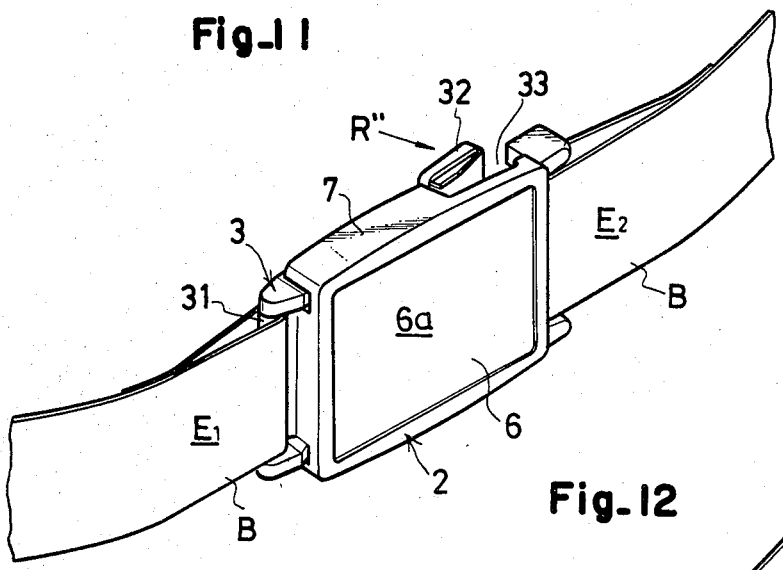
FIG. 11 is a perspective view of the buckle as held in the state shown in FIG. 10.

The work of assembling the two half buckle members or fastening the belt on the user's person, therefore, is accomplished by passing the end $E_1$ of the belt B through the insertion slit 5 of the half buckle member 3 and fastening it by a suitable method around the supporting portion 31 in advance, then inserting the engaging piece 12 of the other half buckle member 2 over the belt end into the insertion slit 5, fitting the forwardly directed face 11 indirectly to the engaging surface portion 20 formed on the rear surface of the supporting portion 31 of the other half buckle member and, in the resultant state, rotating the two half buckle members 2, 3 toward each other in the direction indicated by the arrow "R'", with the joint of the two surfaces 11, 20 serving as the fulcrum of rotation as illustrated in FIGS. 9 to 11.

Figure 12:
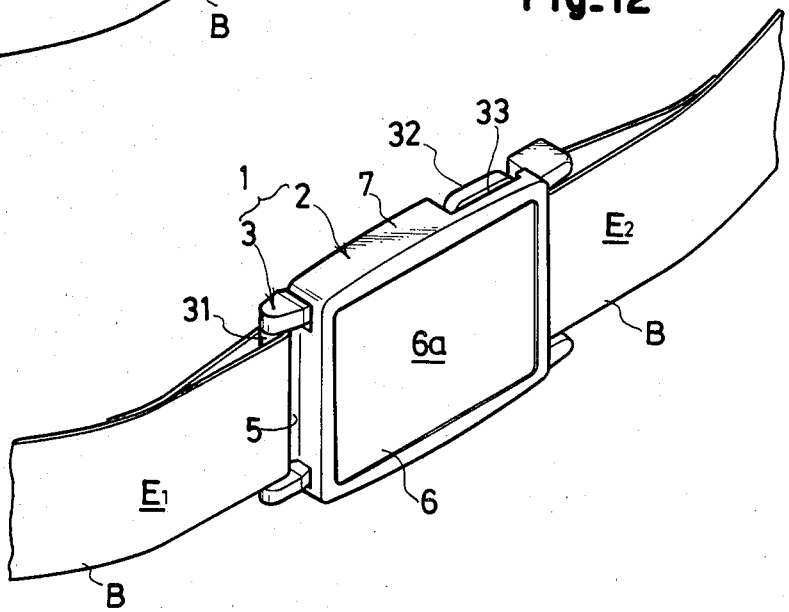
FIG. 12 is a perspective view of the buckle of FIG. 9 as held after completion of the assemblage.

Consequently, in mcuh the same way as in the first embodiment, the engaging surface portions 25 of the other half buckle member 2 snap into fast engagement with the protuberances 16 of the engaging means 14 to complete one buckle 1 as illustrated in FIGS. 12 and 13.

The separation of this complete buckle 1 is effected by forcibly rotating the two half buckle members 2, 3 in the opposite directions (the work involved in this case somewhat resembling an action of two hands folding the buckle 1 into two pieces). In the present embodiment, for the purpose of exposing parts 32 of the upper and lower edges of the rear half buckle member, windows 33 are opened at the corresponding positions in the front half buckle member. The separation of the buckle 1, therefore, may be accomplished by putting the finger tips on the exposed edge 32 and raising the edges 32 in the rearward direction.

In either of the embodiments described above, the buckle of the present invention enables the belt to be fastened and unfastened very easily. Generally, the operation of a buckle compels the user of the buckle to assume a posture of looking down upon the buckle and, therefore, frequently proves to be a troublesome. More often than not, this operation cannot be accomplished without the user pulling in his abdomen. According to the present invention, since the assemblage of the buckle involves the simple operation of placing one of the two half buckle members on top of the other, the user is not required to assume any unnatural posture.

From the standpoint of commercial manufacture, since there are only two parts molded of a plastic material, the buckle can be produced inexpensively. Since the basic components are few and the shapes thereof are simple, the buckle of this invention enjoys a very broad freedom of design in both structural and ornamental senses.

What is claimed is:

1. A plastic buckle comprising two discrete, totally separable half buckle members each having a longitudinal dimension and a lateral dimension, a first half buckle member having a belt-insertion slit along one lateral edge thereof and a second buckle member having another belt-insertion slit along one lateral edge thereof opposite said one lateral edge of said first buckle member, said first buckle member including a first snap engaging means and a fulcrum creating upstanding wall region formed near one lateral edge thereof including a retention ledge located at an uppermost extremity of the fulcrum creating upstanding wall region, said second buckle member including a second snap engaging means adapted for snapping engagement with said first snap engaging means and fulcrum engaging portion formed near a lateral edge wherein said fulcrum engaging porton is adapted to be caught by said retention ledge, whereby the two buckle members are assembled into one complete buckle by positioning the fulcrum engaging portion of the second buckle member adjacent the fulcrum creating upstanding wall region with the first buckle member angularly disposed relative to the second buckle member, then rotating the two buckle members toward each other with the point of contact of the two buckle members serving as the fulcrum of rotation and snapping the two buckle members into fast union by resiliently engaging the first snap engaging means of the first buckle member with the second snap engaging means of the second buckle member.

2. The plastic buckle according to claim 1, wherein said snap engaging means of said first half buckle member are a pair of roundish protuberances provided on the rear surface of said first half buckle member and said snap engaging means of said second half buckle member are a pair of surface portions constituting notches formed on the sides of said second half buckle member.

3. The plastic buckle according to claim 1, wherein said first half buckle member has the rear surface thereof formed in a concave structure capable of encasing the portion of said second half buckle member excluding said belt-insertion slit.

4. The plastic buckle according to claim 1, wherein said first half buckle member has the front surface thereof decorated.

5. The plastic buckle according to claim 1 wherein the retention ledge associated with the fulcrum creating upstanding wall region extends longitudinally outwardly of the first buckle member.

6. The plastic buckle according to claim 1 wherein the retention ledge associated with the fulcrum creating upstanding wall region extends longitudinally inwardly of the appropriate lateral edge on the first buckle member.

* * * * *